United States Patent [19]

Mock et al.

[11] Patent Number: 4,956,830

[45] Date of Patent: Sep. 11, 1990

[54] WATCH HAVING A CASE FORMED AT LEAST PARTIALLY FROM A HARD MATERIAL

[75] Inventors: Elmar Mock; Georges A. Gabus, both of Bienne, Switzerland

[73] Assignee: ETA SA Fabriques d'Ebauches, Grenchen, Switzerland

[21] Appl. No.: 113,423

[22] Filed: Oct. 26, 1987

Related U.S. Application Data

[63] Continuation of Ser. No. 916,432, Oct. 7, 1986, abandoned.

[30] Foreign Application Priority Data

Oct. 7, 1985 [CH] Switzerland ..... 04300/85

[51] Int. Cl.[5] ..... G04B 37/00; G04B 29/00

[52] U.S. Cl. ..... 368/280; 368/299; 368/319

[58] Field of Search ..... 368/88, 276, 294–297, 368/299–301, 314, 318

[56] References Cited

U.S. PATENT DOCUMENTS

| | | | |
|---|---|---|---|
| 360,477 | 4/1887 | Potter | 368/299 |
| 2,719,403 | 10/1955 | Gisiger | 368/291 |
| 3,861,990 | 1/1975 | Kasai et al. . | |
| 4,620,798 | 11/1986 | Scarinzi | 368/276 |

FOREIGN PATENT DOCUMENTS

| | | | |
|---|---|---|---|
| 0098795 | 1/1984 | European Pat. Off. . | |
| 0129274 | 12/1984 | European Pat. Off. . | |
| 0150746 | 8/1985 | European Pat. Off. . | |
| 2730930 | 1/1978 | Fed. Rep. of Germany . | |
| 3340314 | 9/1984 | Fed. Rep. of Germany . | |
| 2254814 | 7/1975 | France | 368/300 |
| 2397668 | 2/1979 | France . | |
| 2437024 | 4/1980 | France . | |
| 52-16382 | 9/1977 | Japan . | |
| 53-37671 | 12/1978 | Japan . | |
| 250700 | 9/1947 | Switzerland . | |
| 379407 | 6/1964 | Switzerland . | |
| 400020 | 9/1965 | Switzerland . | |
| 517963 | 2/1972 | Switzerland . | |
| 613592 | 4/1980 | Switzerland . | |

*Primary Examiner*—Vit W. Miska

*Attorney, Agent, or Firm*—Sughrue, Mion, Zinn, Macpeak and Seas

[57] ABSTRACT

The setting stem 27 of a watch is engaged in a radial hole 29 of an inner metallic caseband 16 with a packing 31 to assure fluid tightness. An outer caseband 3 of hard material includes a radial hole 28 aligned with the hole in the inner caseband. A crown 32 of the same material as the outer caseband may cap the stem. This arrangement enables uniting the wear resistant properties of the hard material with good fluid tightness of the stem.

5 Claims, 1 Drawing Sheet

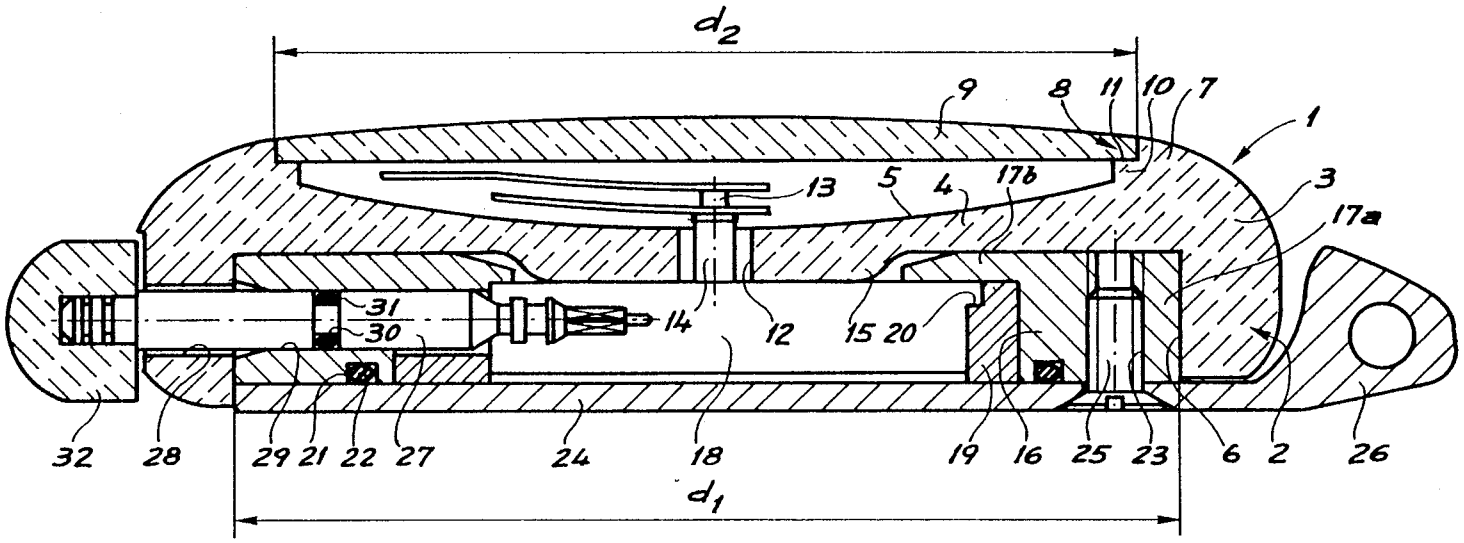
1
2
3
4
5
6
7
8
9
10
11
12
13
14
15
16
17a
17b
18
19
20
21
22
23
24
25
26
27
28
29
30
31
32
$d_1$
$d_2$

WATCH HAVING A CASE FORMED AT LEAST PARTIALLY FROM A HARD MATERIAL

This is a continuation of application Ser. No. 916,432, filed Oct. 7, 1986, now abandoned.

This invention concerns timepieces which include a case fashioned at least partially :rom hard natural mineral materials such as granite and semi-precious stones or artificial materials such as carbides or nitrides of certain metals such as tungsten or titanium.

BACKGROUND OF THE INVENTION

One of the difficulties encountered in the realization of a timepiece of this type consists of assuring the fluid tightness thereof where the time setting stem traverses the case. In effect, it is known that fluid tight sealing on the surface of a hard material such as stone can only be mediocre.

For this reason there has already been proposed an assembly arrangement for the time setting stem which includes a tube radially driven into the base plate of the movement so as to be fluid tight with the base plate and traversed by the time setting stem. The latter receives at its outer extremity the crown which in turn is rendered fluid tight on the outer end of the tube by a packing fixed between an annular flange on the crown and the outer surface of the stem.

This arrangement has not proven satisfactory for several reasons.

Firstly, it necessitates the presence of the tube which must be manufactured and assembled, this increasing the price of fabrication of the timepiece.

However, if the case is fashioned at least partially of hard material, i.e. includes most frequently an outer caseband manufactured from this material (in order to render the case wear resistant), it is necessary to provide where the tube traverses this caseband, a clearance opening downwardly and extending to above the tube. This clearance is necessary to enable placing the movement provided with its tube into the case.

It is known that the machining of a hard material gives rise to serious problems since the risks of rupture of the workpiece in the course of being machined are very high. The clearance in question considerably weakens the workpiece at the place where it must be provided in a manner that said risks increase still further. Furthermore, when the timepiece is worn, the clearance may form a starting place for ruptures in case of shocks.

There has been furthermore proposed (U.S. Pat. No. 4,620,798), in a watch case including an outer caseband of hard material and an inner caseband of rigid but readily machinable material, to provide in the inner caseband a clearance for the crown, this clearance being closed on the outer side by the corresponding part of the outer caseband, but which opens downwardly in order to render the crown accessible. The stem fixed to the crown then traverses a radial hole pierced in the inner caseband in which sealing is assured by means of an annular packing placed in a groove machined in the stem. This packing is pressed against the wall of the radial hole.

This arrangement naturally guarantees a very satisfactory sealing since the packing acts on metallic surfaces, but it leads to a rather mediocre operability of the crown since the latter must be operated via the back face of the watch.

This invention provides a watch equipped with a mounting arrangement of the type described above which avoids these difficulties.

SUMMARY OF THE INVENTION

The invention thus provides a watch the case of which is at least partially formed from a hard material, such case being of the type including an outer caseband formed of hard material and an inner caseband formed of rigid but easily machinable material, said inner caseband including a radial hole for accommodating a setting stem engaged therein in a fluid tight manner by means of a packing lodged in a peripheral groove on the stem so as to be applied against the wall of the hole, said outer caseband including a radial hole aligned with the hole in the inner caseband through which the stem passes towards the exterior.

The arrangement according to the invention presents the advantage of rendering the crown perfectly accessible since it may be mounted at the end of the stem outside the caseband of hard material, while maintaining the advantage of very good fluid tightness, resulting from the fact that the packing acts between two metallic surfaces.

Furthermore, the outer caseband of hard material includes a radial hole which certainly weakens the caseband at this place, but to a substantially lesser degree than if one were to provide a downwardly opening clearing. Effectively, in the caseband conceived according to the invention, there remains material completely surrounding the passage of the stem, this leading to decreased fragility as much during the manufacture (fewer rejects) as during the wearing (better shock resistance). This advantage is particularly notable when the outer caseband is machined from a block of hard material such as natural stone or a monocrystalline oxide. It is to be further noted that with the seal placed on the stem, one may realize a crown manufactured entirely from the same material as the outer caseband.

BRIEF DESCRIPTION OF THE DRAWINGS

The single figure shows a broken diametral cross-section of a timepiece in accordance with the invention.

DESCRIPTION OF THE PREFERRED EMBODIMENT

According to the embodiment shown on the single figure, the timepiece in accordance with the invention includes a case 1 comprising a part 2 fashioned of hard natural material as for instance granite, a semi-precious stone, or artificial material such as a metallic carbide, a mono-crystalline metallic oxide or the like. This part which is integrally formed includes a ring forming an outer caseband 3 for the case and a hub portion 4 which blanks off the ring at approximately three quarters of its height, this hub portion providing on its upper face the dial 5 of the timepiece.

It is thus that the part 2 bounds a central circular cavity 6 which here is coaxial to the outer caseband 3. The latter exhibits a semi-toroidal periphery. However, it is to be noted that the form of the caseband 3 and the location of cavity 6 as shown are not intended to limit the scope of the invention and are determined only by the appearance which it is desired to give to the timepiece, it being quite possible to offset the cavity 6 from the center relative to the general form of the stone outer 3 which itself may assume extremely varied outer forms determined likewise by appearance considerations.

The face of hub portion 4 forming the dial 5 is concave and is bordered by a raised-up peripheral portion 7 of the outer caseband 3. This portion 7 defines by its form, positioning and fastening means 8 for a crystal 9. In the embodiment shown, these means comprise an annular step 10 bounding a shoulder 11 on which may be applied crystal 9 by means of a glue joint. The crystal 9 is thus buried in the thickness of the outer caseband.

Hub portion 4 is pierced at its center with a hole 12 for the passage of the concentric shafts for hands 13 and 14. Furthermore, the central zone includes a stiffening portion 15 in order to stiffen the hub portion at this place. This stiffening portion is obtained by applying the machining operation only to the periphery of the sump of cavity 6 at the end of the machining operation.

An inner metallic caseband 16 is placed in cavity 6. This caseband comprises an annular ring 17*a* from which a flange 17*b* extends towards the interior and which is glued to the outer caseband 3 by glue joints interposed between the respective peripheral exterior and interior walls of the casebands and likewise (although not indispensable), between the upper face of inner caseband 16 and the portion of the corresponding lower surface of the hub portion 4.

The inner caseband 16 is initially intended to receive the movement 18 of the timepiece by means of a casing ring 19. In the example shown, the movement 18 is assumed to be of the barrel type, the casing ring 19 thus not having a constant radial section over its entire periphery as seen to the left and the right in the figure. The casing ring includes a shoulder 20 to accommodate a collar or flange fashioned in a well-known manner around the periphery of the movement.

An annular groove 21 is provided in the lower surface of the inner caseband in order to receive a packing 22. Furthermore, several threaded holes 23 are provided in such caseband in order to permit its assembly with a back cover 24 by means of screws 25. The back cover 24 is formed by a circular plate, the form of which is adapted to the form of the assembly and which is adjusted almost entirely in the opening of the cavity 6. This plate bears attachment lugs 26 at noon and at 6 o'clock intended to fasten a bracelet not shown on the drawing.

It is thus to be seen that the timepiece requires for its fluid tightness only one seal for the back cover acting efficiently through contact with the metal, the packing being furthermore secured at all places by the rectangular section bounded by the back cover and the groove 21.

It is noted likewise that the inner caseband presents an outer diameter $d_1$ greater than the diameter $d_2$ of the crystal. Such arrangement is deliberate in order to confer to the inner caseband 16 a support function for the fragile zone situated at the junction between the hub portion 4 and the outer caseband 3. In case of shock whilst being worn, the risks of rupture at this place are thus substantially reduced.

There will now be described in detail how the passage for the time setting stem 27 is obtained. The latter traverses a cylindrical radial hole or bore 28 pierced in the outer caseband 3 as well as a cylindrical radial hole or bore 29 provided in the inner caseband 16, this latter being adjusted to the diameter of the stem 27 in order to permit the rotation thereof while assuring its guidance. The stem 27 itself is provided with a groove 30 which is situated approximately at mid point in the radial hole 29 and which is intended to receive a packing 31. It is thus again a case of a seal acting against metallic surfaces which here assures the fluid tightness with respect to the exterior. A crown 32 fashioned from the same material as the part 2 may cap the outer end of the stem 27 being retained on the latter by gluing for instance.

As may be seen from the drawing, the stem 27 has a constant diameter throughout the bores 28,29, the bore 28 has a larger diameter than the bore 29 to provide a substantial degree of clearance for the passage of the stem, and the stem extends through the bore 29 with a tight or minimum degree of clearance.

It will be noted that the hole provided in the inner caseband 16 for the passage of stem 27 is almost tangent to the radial plane containing the upper surface of the movement 18. This is due to the fact that the stem 27 must have a comparatively large diameter in order to accommodate therein groove 30 intended for seal 31. If the lower face of the hub portion 4 were flat, there would result therefrom that the thickness of the material metal between hole 29 and the upper face of the inner caseband 16 would be very small, which could lead to rendering hole 29 oval, and consequently no longer able to guarantee good contact with seal 31 and hence a loss of sealing.

In view of the fact that cavity 6 includes a groove surrounding the stiffening portion 15 and which permits the utilization of a thicker inner caseband 16, one may assure fluid tightness of the watch without however having to increase the thickness thereof.

This special solution has been made possible owing to the fact that the face of the hub portion 4 forming dial 5 is concave and that the housing is machined initially over the entire outer surface and subsequently only on the surface of the sump. From this the cross-section of the hub portion at step 10 remains sufficient to resist the pressure which must be applied thereto during the machining operations.

The machining of part 2 of hard material is obtained preferably by means of an abrasion process using a diamond grinder known to specialists in the art. Within the framework of the invention, this machining does not require any particular precision in view of the presence of the inner caseband which here is the element of the timepiece assuring all positioning functions requiring precision, including the positioning of the movement, the tightening of the packings 22 and 31 and the positioning of screws 25 with respect to the back cover.

What we claim is:

1. A watch, comprising: a case at least partially formed from a hard material incapable of establishing a reliable fluid tight seal, said case including a continuous and uninterrupted, closed outer caseband (3) formed of said hard material, and an inner caseband (16) housing a watch movement (18) and formed of a rigid but easily machinable metallic material capable of establishing a reliable fluid tight seal, said inner caseband including a first cylindrical bore (29) extending radially therethrough for accommodating a setting stem (27) disposed therein and extending therethrough, said stem being engaged therein in a fluid tight manner by a packing (31) lodged in a peripheral annular groove (30) on the stem so as to be sealingly applied against an inner circumferential wall of said first cylindrical bore, said outer caseband including a second cylindrical bore (28) extending radially therethrough and axially aligned with the first cylindrical bore in the inner caseband, and the stem passing through said second cylindrical bore and having an outer end portion extending to an exterior of the watch, the diameter of the second bore being larger than the diameter of the first bore to enable the insertion of the stem through said bores and into the movement, and the thickness of the inner caseband being greater than the thickness of the movement to establish a sufficient strength of the inner caseband surrounding the first bore to prevent any cross-sectional flattening thereof and an attendant disruption of the stem seal therewith, wherein the outer caseband is fashioned integrally with a central hub portion (4) defining a dial (5), and wherein a cavity (6) bounded by the outer caseband and the central hub portion and intended to house the watch movement includes a recessed annular sump surrounding a thickened stiffening portion (15) provided in a central part of the hub portion, the inner caseband being seated against said sump, and the radial length of said annular sump corresponding approximately to the radial length of the inner caseband.

2. A watch as set forth in claim 1, wherein at the exterior of the outer caseband the setting stem is capped with a crown (32) formed of the same material as the outer caseband.

3. A watch as set forth in claim 1, wherein said hub portion is surrounded by crystal positioning and fixing means (8) machined in the body of the outer caseband.

4. A watch as set forth in claim 1, wherein said outer caseband is formed from natural stone material.

5. A watch as set forth in claim 1, wherein said outer caseband is formed from a monocrystalline oxide material.

* * * * *